United States Patent [19]

Corrigan

[11] Patent Number: 4,550,968

[45] Date of Patent: Nov. 5, 1985

[54] BATTERY PACK CONNECTION

[75] Inventor: John J. Corrigan, Washington, Conn.

[73] Assignee: Anton/Bauer, Inc., Shelton, Conn.

[21] Appl. No.: 660,083

[22] Filed: Oct. 12, 1984

[51] Int. Cl.[4] ..... H01R 13/639

[52] U.S. Cl. ..... 339/91 R; 339/75 M

[58] Field of Search ..... 339/75 R, 75 M, 91 R; 248/222.4, 223.1, 223.2

[56] References Cited

U.S. PATENT DOCUMENTS

| | | | |
|---|---|---|---|
| 498,804 | 6/1893 | Manning | 248/222.4 |
| 871,670 | 11/1907 | Calbeck | 248/223.1 |
| 3,270,995 | 9/1966 | Shears | 248/222.4 |
| 3,425,025 | 1/1969 | Williams | 339/75 M |
| 4,218,107 | 8/1980 | Wilson | 339/91 F |

*Primary Examiner*—John McQuade

*Attorney, Agent, or Firm*—Kramer and Brufsky

[57] ABSTRACT

A battery pack connection consists of a flat male plate having a plurality of spaced headed projections and female electrical terminals carried within a projecting housing while a flat female plate has a plurality of keyholes designed to facilitate receiving the projections and male electrical terminals positioned within a recess together with a flexible strip that engages a projection to enable locking and unlocking of the plates in both their electrical and mechanical connected relationship. The flexible strip is moved away from its locking position by a cam on a pivoted actuator which can be moved by a finger.

10 Claims, 8 Drawing Figures

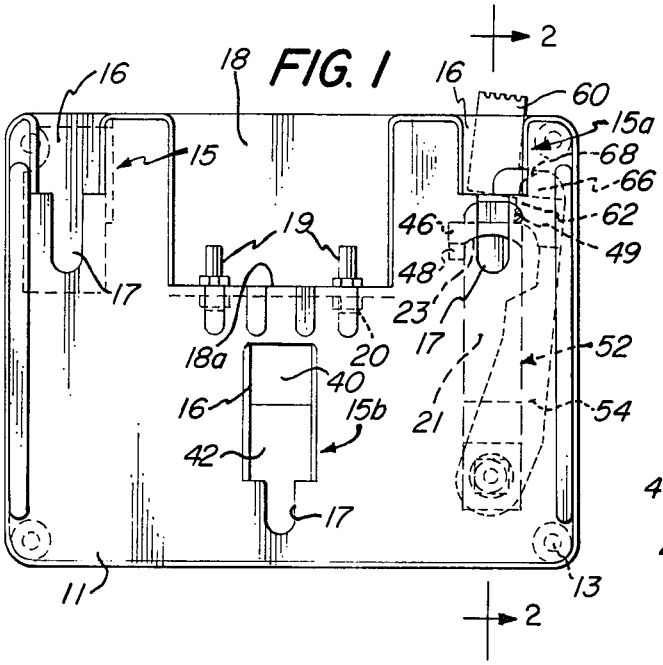
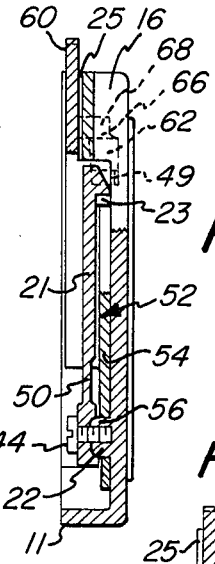
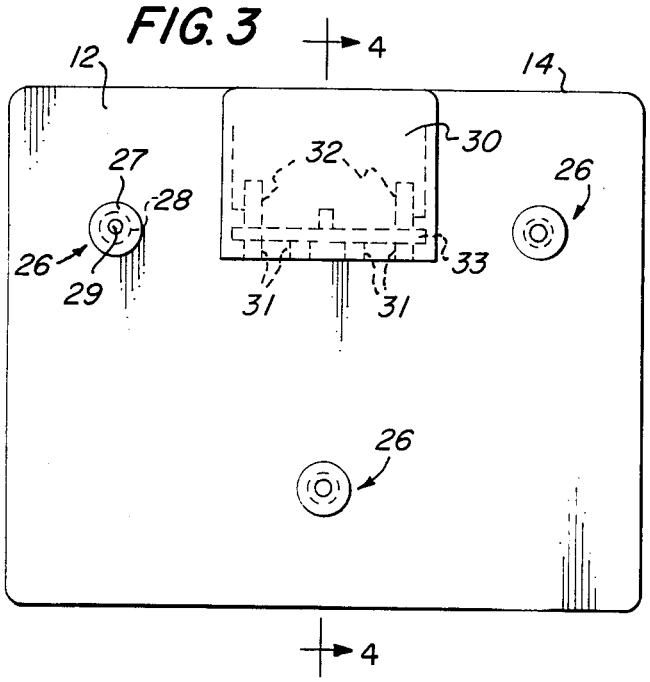
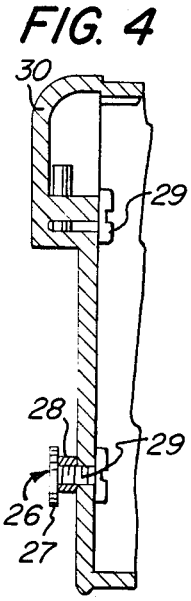
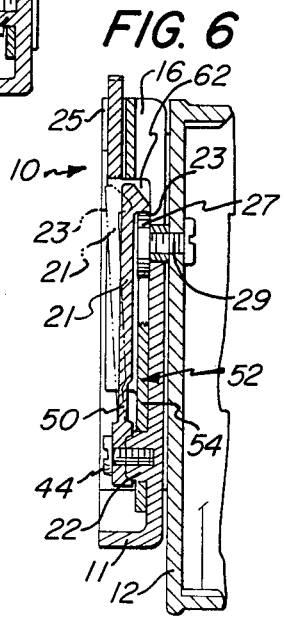
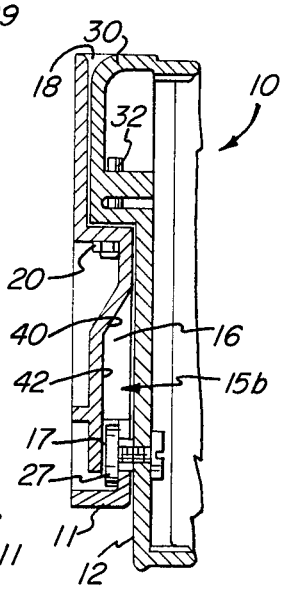
FIG. 5
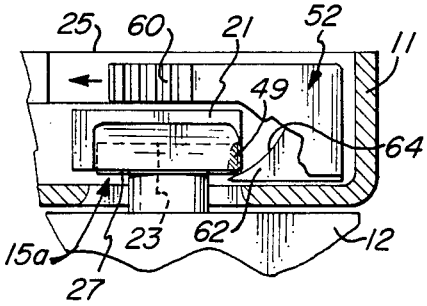
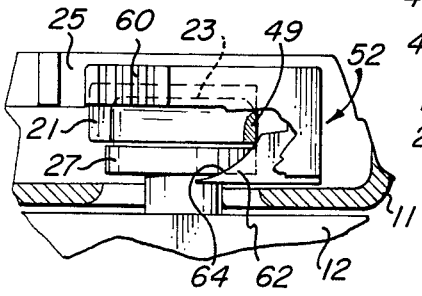

BATTERY PACK CONNECTION

BACKGROUND OF THE INVENTION

1. Field of the Invention

This invention relates to a battery pack connection, and more particularly, a battery pack connection in which a battery pack can be quickly and efficiently replaced upon discharge of the batteries.

2. Description of Prior Art

The present invention has particular utility when used with electrical devices that are portable and which derive their power from batteries that are contained within a pack and which are generally connected by a cable to the device. Typically, the power supplied by the battery pack is utilized quite rapidly requiring frequent replacement of a discharged battery pack by a freshly charged pack. Heretofore, the replacement of a pack has generally required both an operation which effects disconnecting of the electrical connection between the pack and the device and also another operation which separates the pack from its supporting structure so that not only was replacement somewhat time-consuming and requiring the user's undivided attention, but also it was susceptible to improper securement and connection.

Therefore, in U.S. Pat. No. 4,218,107, assigned to the same assignee as the present invention, a battery pack connection is disclosed which includes a female plate that is secured, as for example, directly to a portable device or may be carried by the user by being strapped to the user's body. The female plate is formed with a plurality of keyholes together with at least one male terminal with the keyholes and the terminal extending in the same direction but with the terminal being positioned within a recess spaced beneath the plane of the female plate. A male plate cooperates with the female plate and may form one side of a battery containing recepticle or pack. The male plate has a plurality of circular headed projections extending therefrom and at least one female terminal positioned within a housing that projects from the plane of the male plate.

In use, the female plate is fixed and connected to the electrical device and if the male plate is part of the battery pack, the user positions the male plate against the female plate with initial alignment occurring between the recess and the housing and with said alignment preventing lateral shifting of the plate with respect to the slots of the keyholes. The user can then only move the male plate in the direction of the keyhole slots until the headed projections enter into circular openings of the keyholes. The male plate is then further moved to position the projections within the slots of the keyholes with said movement causing electrical connection between the male and female terminals.

When the male plate has achieved its connected position, a tensioned flexible strip that is positioned behind one keyhole reverts to its normally biased position wherein it has a ledge which engages the head of the projection in said keyhole and prevents the two plates from moving from their connected position.

For removing the plate, the user merely bends the flexible strip from its normal position which unlocks the engagement between the strip and the projection to thereby permit the male plate to be moved so as to position the headed projections within the circular openings of the keyholes. At this position, the terminals have been disconnected and the male plate can be removed from the female plate in order to permit a charged battery pack to be replaced on the female plate.

The portion of the keyholes in the female plate for receiving the circular headed projections on the male plate are also all circular in shape and of a similar diameter. This precise horizontal and vertical alignment of all the projections simultaneously with the respective keyholes is a prerequisite for proper engagement of the two parts. This prealignment process is relatively difficult and has the undesirable effect of impeding the overall speed of engagement. This design also requires two distinct and perpendicular motions for full engagement; insertion of the projections into the keyholes followed by a lateral motion which make electrical contact and locks the mating parts. This double motion further reduces the overall speed of engagement. Also, in order to remove the male plate from the female plate so as to readily replace the battery pack, it was necessary to hold the flexible strip in its bent position with one hand while removing the male plate with the other, which is somewhat awkward. In addition to requiring two hands, disengagement was further complicated by the requirement of two distinct motions; a lateral movement to electrically disconnect followed by a retraction in a direction perpendicular to the first. The improved structure of this invention cures these problems.

SUMMARY OF THE INVENTION

In accordance with this invention, the top of each keyhole slot on the female plate, rather than being closed and/or circular is rectangular and elongated in the direction of the slot. Where possible, for example, in those slots adjacent the top or side edge, the slots open into the edge enabling the corresponding headed projections on the male plate to be quickly located in the slots. The remaining interior slot or slots are provided with an inclined ramp to guide a mating headed projection on the male plate quickly into locking engagement with the bottom of the slot and as a consequence causes the remaining headed projections to seek their locked positions. Thus, alignment prior to engagement is significantly easier requiring positioning of only one projection instead of a plurality and in one plane. instead of two. Engagement is further expedited by a one motion process instead of two.

The flexible locking strip is also provided with a latch actuator having a cam for contact with the flexible strip so that the flexible strip can be moved away from its normally biased position enabling the headed projections to be removed from the keyhole slot. In this position, the latch actuator cam projects into the keyhole slot in front of the flexible strip wherein upward movement of the male plate and headed projection will return the latch actuator to a position out of contact with the flexible strip, permitting the same to be resiliently bowed to clamp a headed projection when placed in the keyhole slot. Movement of the latch actuator from this position towards the strip causes the cam to raise the strip and remain in a raised position, wherein the male plate can be removed from the keyhole slots with the same hand. Alternatively, in the event the latch actuator has not been returned to a position out of contact with the flexible strip, the latch actuator is provided with a second cam having a camming surface which will contact a downwardly moving headed projection inserted in the keyhole slot to move the latch actuator to its first position out of contact with the flexible strip.

Once again, mating relation of the plates can be accomplished with one hand. This convenience is further enhanced by a one motion removal rather than the previous two motion and direction removal process.

BRIEF DESCRIPTION OF THE DRAWING

Other features and advantages will hereinafter appear from the following specification and claims and from the accompanying drawing, wherein:

FIG. 1 is a front view in elevation of the female plate of the battery pack connection;

FIG. 2 is a cross-sectional view taken substantially along the plane indicated by line 2—2 of FIG. 1;

FIG. 3 is a rear view in elevation of the male plate of the battery pack connection;

FIG. 4 is a partial cross-sectional view taken substantially along the plane indicated by line 4—4 of FIG. 3;

FIG. 5 is a partial longitudinal cross-section of the two plates in their connected position;

FIG. 6 is a partial cross-sectional view similar to FIG. 2, taken at the same location, but with the male plate attached to the female plate;

FIG. 7 is a top plan view, with portions removed and shown in section for purposes of illustration as to the operation of the battery pack connection, of the connection shown in FIG. 6 with the headed projections on the male plate locked in their.respective keyhole slots; and FIG. 8 is a view similar to FIG. 7, but with the male plate in a position to be removed from the female plate.

DETAILED DESCRIPTION OF THE PREFERRED EMBODIMENT

Referring now to the drawing in detail, wherein like numerals indicate like elements throughout the several views, the battery pack connection of the present invention is generally indicated by the reference numeral 10 and includes a female plate 11 and a male plate 12. The plate 11 has a plurality of threaded apertures 13 on its backside corners by which it may be secured to an electrical device or a support or a recharging unit (not shown) while the male plate 12 constitutes one side of a closed container 14, which contains rechargable batteries. The container, if desired, may be secured to the male plate by fasteners extending into the peripheral edges of the plate. It will be understood that, if desired, the two plates may be reversely connected to the device and batteries.

The female plate 11 is formed with a plurality of keyholes 15 cut in its front surface, each having an elongated rectangular opening 16 and a narrow depending slot 17. A pair of upper keyholes 15 and **15*a* have openings 16 terminating in the upper edge of plate 11. A middle interior keyhole 15*b* is provided with an inclined ramp portion 40 sloping from the front surface towards the rear surface of the plate 11 and a connecting vertical guideplate 42 extends downwardly from the ramp 40 behind the interior slot 15*b***.

Formed between the two upper keyholes 15, **15*a* is an open top recess 18 in which two male terminals 19 are secured though if desired, a different number may be employed. The terminals 19, as shown, are positioned at the bottom 18*a* of the recess and secured thereto as by passing through holes formed therein with nuts 20** threaded onto the bottom of the terminals to secure them in place. The remaining exposed threaded portions enable wires to be secured thereto on the opposite side of the female plate to effect electrical connection to the terminals. By positioning the terminals within the recess, they accordingly are located beneath the face of the front of the female plate and hence less subject to abuse during the substitution of one battery pack for another or when exposed.

One end of a strip 21 is secured on the backside of the female plate at one end, as at 22, by a threaded fastener 44 and is normally biased towards the backside. The strip 21 overlies the depending slot 17 of keyhole **15*a* and is formed with a somewhat circular ledge 23 that essentially closes the rectangular opening 16 of the keyhole 15*a*, when the strip is immediately behind the rear surface or backside of plate 11. The top of the strip 21 is located beneath the top edge of plate 11, and includes a guide projection 46 seated on a pin 48. The opposite edge of strip 21 includes a downwardly and outwardly extending projection 49. A user is capable of bending the strip 21 about a flexible or "living" hinge 50 away from the backside or rear surface of the female plate 11 by use of a latch actuator 52, as described in detail hereinafter. As shown, the female plate 11 has a cut-out 25 in its top edge through which one notched or serrated end 60 of latch actuator 52** projects.

The male plate 12 is formed with a plurality of projections 26, each of which has a large head 27 and an integral narrow leg portion 28. Each projection may be secured to the male plate by being formed with an axial threaded hole into which a screw 29 from the backside of the male plate is threadable.

Extending beyond the face of the male plate is an integral housing 30 having the generally rectangular shape shown. The housing is formed with a plurality of holes 31 extending upwardly for enabling mating access of the male terminals to female terminals 32. The terminals 32 are clinched onto a flat insulating plate 33 supported in a slot formed on the rear surface.

The latch actuator 52 includes a body portion 54 pivoted about the axis of threaded fastener 44. The top end 60 of the latch actuator forms a serrated finger pull attached to body portion 54 which extends through cutout 25 in the top edge of female plate 11. Extending outwardly from the surface of body portion 54 between the juncture of finger pull 60 and body portion 54 is a cam 62 having a surface 64 which is adapted to contact projection 49 on strip 21 upon pivoting of latch actuator about the axis of fastener 44 towards strip 21 to raise or move the strip 21 away from the rear surface of female plate 11 as shown in phantom lines in FIG. 6 and in FIG. 8 enabling the headed projection 27 to clear ledge 23 in keyhole slot **15*a* and all the projections 27** to be removed from their slots.

The latch actuator cam 62 projects into keyhole slot **15*a* wherein upward movement of the male plate 12 and headed projection 27 in the slot 15*a* will contact the bottom of cam 62 and return the latch actuator 52 to a position out of contact with projection 49 on strip 21, as shown for example in FIG. 7 and in full lines in FIG. 6, permitting the strip to be resiliently bowed about hinge 50 to clamp the headed projection 27 in keyhole slot 15*a* upon insertion of a new battery pack in slot 15*a*. Movement of the latch actuator 52 from this position towards strip 21 causes cam 62 to raise the strip 21 and to remain in a raised position, wherein the male plate can be removed from the keyhole slots 15, 15*a* and 15*b* with the same hand. In the event latch actuator 52 is inadvertently in the position of FIG. 8 wherein surface 64 of cam 62 is in contact with projection 49, the insertion of a headed projection 27 in slot 15*a* accompanied by downward movement will cause the projection 27 to strike a second downwardly sloping cam surface 68 on a cam 66 above cam 62 on latch actuator 52 at the juncture of pull 60 and body portion 54 to pivot the latch actuator 52 away from strip 21 or in a clockwise direction as viewed in FIG. 1 permitting the ledge 23 to lock the projection 27 in slot 15***a*.

In use, assuming the male plate 12 is part of the battery pack container and the female plate 11 is secured to the electrical device or to a supporting structure carried by the user, the user positions the male plate against the female plate and shifts the male plate until the heads 27 of the projections extend into and beyond the larger expanded openings 16 of the keyholes. The ramp 40 behind slot 15*b* aids to guide the middle projection 27 which in turn causes the remaining projections to readily enter the portions 17 of each slot. Entry of projection 27 in slot 15*a* causes the strip 21 to be bent backwards from its normal position by the head of the projection 27 contacting the ledge 23, until the head clears the ledge which snaps over the projection 27. This also causes latch actuator 52 to pivot and return to a position adjacent to contact with the strip 21, if cam 66 projected into slot 15*a*. Moreover, this positions the female terminals 32 of the male plate 12 in alignment with the male terminals 19 of the female plate 11. The user then merely relatively moves the two plates to cause the projections to extend into the slots 17 of the keyholes which also causes the male terminals to enter into the female terminals. When the projections extend essentially completely into the keyholes, the strip 21 is no longer flexed by the head of its associated projection engaging the ledge 23 and accordingly, it reverts to its normal biased condition wherein the ledge, by being above, overlies the head of the projection 27 to lock the two plates together in their connected position. Generally, the bias of the strip is sufficiently great that an audible click is made by the strip when it is permitted to assume its normal position by the plates assuming their locked position.

To remove the battery pack, the user merely bends the strip 21 rearwardly by pushing on the free end of pull 60 pivoting the pull and latch actuator 52 towards strip 21 (in a counterclockwise direction in FIG. 1) to raise the strip 21 away from the rear surface of plate 11 due to the engagement of cam surface 64 with projection 49 on strip 21, which releases the locking of the strip 21 by moving ledge 23 rearwardly of projection 27 in slot 15*a* and permits the male plate 12 to be slid upwardly on the female plate until the heads of all the projections 27 are removed from openings 16. Ramp 40 cams the plate 12 away from plate 11. This also frees the male terminals from the female terminals so that the male plate may then be separated from the female plate by a movement perpendicular to the faces of the plates.

Preferably, each plate is molded integrally of plastic with the strip also being plastic while the headed projection and terminals are formed of plastic or metal.

While the connection of the present invention has been described specifically with application to a battery pack, it should be understood that the invention has universal application to other power or electronic control connections such as the connection of AC power supplies, power taps, micro controls and the like, and the claims appended hereto should be construed to cover all such applications, variations, and modifications, all of which are deemed to fall within the scope thereof.

What is claimed is:

1. A releasable connection for a battery pack or the like comprising a relatively flat male plate and a relatively flat female plate, said plates being adapted to be releasably locked together in connected position; said female plate including a plurality of keyholes with each having an opening and a depending slot, and at least one elongate terminal, said terminal and keyhole slots being elongate in the same direction; said male plate including a plurality of spaced headed projections with there being one for each keyhole and with each projection having head and leg portions, and at least one elongated mating terminal; said male plate being positioned abutting the female plate with the legs of the projections being located in the slots of the associated keyholes and with the one terminal within the mating terminal; ramp means associated with and behind at least one of said keyhole slots for guiding at least one of said headed projections into and out of the depending portion on said keyhole slot; said ramp means including an inclined portion sloping from a front portion of said female plate towards a rear portion thereof connected to a vertical guideplate portion extending downwardly and terminating behind and spaced from said one keyhole slot; and releasable locking means on one of said plates for engaging means on the other of said plates to lock said plates in connected position by preventing relative movement between said plates in the direction of said keyhole slots until said locking means is released.

2. The invention as defined in claim 1 in which the releasable locking means includes a flexible strip positioned on the backside of the female plate and means normally urging the strip against the backside of the female plate.

3. The invention as defined in claim 2 in which the strip includes a ledge positioned opposite the opening of one of the keyholes, said ledge being shaped to be engaged by the head of the projection when located in the opening and to overly the projection when the leg of the projection is positioned within the depending slot in the connected position of the plates.

4. The invention as defined in claim 1 wherein at least one of said keyhole openings opens in an edge of said female plate.

5. The invention as defined in claim 1 wherein said keyhole openings are rectangular in shape.

6. A releasable connection for a battery pack or the like comprising relatively flat male plate and a relatively flat female plate, said plates being adapted to be releasably locked together in connected position; said female plate including a plurality of keyholes with each having an opening and a depending slot, and at least one elongate terminal, said terminal and keyhole slots being elongate in the same direction; said male plate including a plurality of spaced headed projections with there being one for each keyhole and with each projection having head and leg portions, and at least one elongated mating terminal; said male plate being positioned abutting the female plate with the legs of the projections being located in the slots of the associated keyholes and with the one terminal within the mating terminal; ramp means associated with and behind at least one of said keyhole slots for guiding at least one of said keyhole slots for guiding at least one of said headed projections into and out of the depending portion on said keyhole slot; and releasable locking means on one of said plates for engaging means on the other of said plates to lock said plates in connected position by preventing relative movement between said plates in the direction of said keyhole slots until said locking means is released; said releasable locking means including a flexible strip positioned on the backside of the female plate and means normally urging the strip against the backside of the female plate; said strip including a ledge positioned opposite the opening of one of the keyholes, said ledge being shaped to be engaged by the head of the projection when located in the opening and to overly the projection when the leg of the projection is positioned within the depending slot in the connected position of the plates; and means for releasing said locking means to enable said headed projections to be removed from said keyhole slots, said release means including a pivotable actuator plate having a cam for contacting and moving said strip away from the rear of said female plate so that said ledge is out of the path of movement of said headed projection in said one keyhole slot.

7. The invention as defined in claim 6 in which the actuator plate includes an end portion extending above the female plate for enabling manual pivoting of said plate.

8. The invention as defined in claim 7 in which the elongated terminal is a male terminal and is located in a recess in said female plate and the mating terminal is a female terminal that is located on a housing on the exterior of said male plate.

9. The invention as defined in claim 8 in which the recess has a bottom extending transversely to the direction of the side walls of the recess and in which the at least one male terminal is secured on the bottom to extend in the same direction as the direction of the side walls of the recess.

10. A releasable connection for a battery pack or the like comprising a relatively flat male plate and a relatively flat female plate, said plates being adapted to be releasably locked together in connected position; said female plate including a plurality of keyholes with each having an opening and a depending slot, and at least one elongate terminal, said terminal and keyhole slots being elongate in the same direction; said male plate including a plurality of spaced headed projections with there being one for each keyhole and with each projection having head and leg portions, and at least one elongated mating terminal; said male plate being positioned abutting the female plate with the legs of the projections being located in the slots of the associated keyholes and with the one terminal within the mating terminal; and releasable locking means on one of said plates for engaging means on the other of said plates to lock said plates in connected position by preventing relative movement between said plates in the direction of said keyhole slots until said locking means is released; said releasable locking means including:

a flexible strip positioned on the backside of the female plate and means normally urging the strip against the backside of the female plate;

the strip includes a ledge positioned opposite the opening of one of the keyholes, said ledge being shaped to be engaged by the head of the projection when located in the opening and to overly the projection when the leg of the projection is positioned within the depending slot in the connected position of the plates;

means for releasing said locking means to enable said headed projections to be removed from said keyhole slots, said release means including a pivotable actuator plate having a cam for contacting and moving said strip away from the rear of said female plate so that said ledge is out of the path of movement of said headed projection in said one keyhole slot.

* * * * *